US005609145A

United States Patent [19]

Kojima et al.

[11] Patent Number: 5,609,145

[45] Date of Patent: Mar. 11, 1997

[54] INTERNAL COMBUSTION ENGINE IGNITION SYSTEM

[75] Inventors: Masami Kojima, Chiryu; Naohito Kato, Kariya, both of Japan

[73] Assignee: Nippondenso Co., Ltd., Kariya, Japan

[21] Appl. No.: 371,702

[22] Filed: Jan. 12, 1995

[30] Foreign Application Priority Data

Jan. 12, 1994 [JP] Japan ..... 6-001753

[51] Int. Cl.[6] ..... F02P 3/055

[52] U.S. Cl. ..... 123/634; 123/652

[58] Field of Search ..... 123/634, 635, 123/651, 652

[56] References Cited

U.S. PATENT DOCUMENTS 3,824,977 7/1974 Campbell et al. ..... 123/651
5,146,906 9/1992 Agatsuma ..... 123/635
5,193,514 3/1993 Kobayashi et al. ..... 123/634

FOREIGN PATENT DOCUMENTS 3109650 9/1982 Germany .
3734080 4/1989 Germany .
50-112630 9/1975 Japan .

*Primary Examiner*—Andrew M. Dolinar
*Attorney, Agent, or Firm*—Cushman Darby & Cushman IP Group of Pillsbury Madison & Sutro, LLP

[57] ABSTRACT

An ignition system for an internal combustion engine is provided which includes an ignition coil formed with a primary winding and a secondary winding and a switching element for interrupting a current flow through the primary winding of the ignition coil at given timing. The ignition coil has a secondary winding to primary winding turns ratio a which meets the condition of $V_D \cdot a > V_r$ where $V_r$ is a required voltage of a spark plug of the engine and $V_D$ is a breakdown voltage of the switching element which is greater than or equal to 450 V.

1 Claim, 8 Drawing Sheets

INTERNAL COMBUSTION ENGINE IGNITION SYSTEM

BACKGROUND OF THE INVENTION

1. Technical Field of the Invention

The present invention relates generally to an ignition system for internal combustion engines, and more particularly to a so-called induction discharge non-contact type ignition system which interrupts a primary current flow through an ignition coil to produce a desired level of required secondary voltage for initiating an ignition arc through a spark plug.

2. Background Art

U.S. Pat. No. 5,193,514 to Kobayashi et al. and U.S. Pat. No. 3,824,977 to Campbell et al. teach conventional ignition systems for internal combustion engines.

FIG. 9 shows a prior art ignition system similar to those disclosed in the above references. An igniter 20 has a Darlington transistor 21 serving to turn on and off a primary current flowing through an ignition coil 22. The Darlington transistor 21 is provided with two npn bipolar transistors.

The ignition coil 22 has a primary winding 23 connected to a collector electrode of the Darlington transistor 21 and a secondary winding 24 connected to a spark plug (not shown). A zener diode 25 is connected to the Darlington transistor 21 for protecting the transistor 21 against the overvoltage. A breakdown voltage $V_D$ of the transistor 21 is determined based on a zener voltage $V_Z$ of the zener diode 25 which is selected to be about 350 V in view of effective withstand voltage characteristics of the Darlington transistor 21.

In recent years, a DLI (Distributor Less Ignition) system which is designed to supply sparking energy of an ignition coil directly to a spark plug without use of a distributor, has become more prevalent. The DLI system, as shown in FIG. 10, has a high withstand voltage diode 100 interposed between a primary winding 8 and a secondary winding 9 of an ignition coil 7 for preventing the occurrence of a sparking failure of a spark plug due to a secondary on-voltage induced in the secondary winding 9 when a primary current is supplied to the ignition coil. The secondary on-voltage depends upon a secondary winding to primary winding turns ratio of the ignition coil.

It is difficult to decrease the turns ratio of the ignition coil to eliminate the need for the high withstand voltage diode 100 because in doing so, a secondary voltage would not reach a required level with a typical zener voltage $V_Z$ of 350 V.

The ignition system taught in U.S. Pat. No. 3,824,977 has a secondary winding to primary winding turns ratio of an ignition coil raging from 40 to 60 for increasing an ignition arc current produced through a spark plug to improve the sparking ability. Additionally, in the ignition system disclosed in U.S. Pat. No. 5,193,514, an ignition coil has a turns ratio of less than 70 for developing a voltage of at least 6 kV across electrodes of a spark plug. It will be noted that while conventional ignition coils commonly have a turns ratio of about 90, the ignition coils, as taught in the above references, have decreased turns ratios. These references, however, do not refer to a reduction in primary voltage of the ignition coil at all.

Generally, although a decrease in turns ratio of an ignition coil will produce various beneficial results, it becomes difficult to decrease the turns ratio as a required secondary voltage is increased.

In the prior art ignition system shown in FIG. 9, a primary voltage $V_1$ of the primary winding 23 of the ignition coil 22 is determined based on a secondary voltage $V_2$ and a turns ratio a according to the relation of $V_1=V_2/a$. Thus, a decrease in the turns ratio a to obtain a preselected level of the secondary voltage $V_2$ will cause the primary voltage $V_1$ to increase. When the primary voltage $V_1$ exceeds the zener voltage $V_Z$(=350 V), it is restricted by the zener voltage $V_Z$ so that the secondary voltage $V_2$ of the ignition coil cannot reach a required secondary voltage $V_r$.

Taking as an example a case where the turns ratio a is 70, if the required secondary voltage $V_r$ is relatively low (e.g., $V_r$=15 kV), then the primary voltage $V_1$ will be 15 kV/70=214 V. In this case, since $V_1<V_Z$ (350 V), the primary voltage $V_1$ is not affected by the zener voltage $V_Z$ so that the required secondary voltage $V_r$ is produced.

On the other hand, when the required secondary voltage $V_r$ is relatively high (e.g., $V_r$=30 kV), then the primary voltage $V_1$ will be 30 kV/70=428 V so that $V_1>V_Z$ (350 V). The primary voltage $V_1$ is, thus, affected by the zener voltage $V_Z$ so that it is increased only to 350 V. Accordingly, only a secondary voltage $V_2$ of approximately 24.5 kV(=350 V·70) will be produced. The great decrease in the secondary voltage $V_2$ relative to the required secondary voltage $V_r$(=30 kV) increases the possibility of misfiring, thereby degrading the drivability. It will, thus, be appreciated that the use of a zener diode for protecting a switching element from the overvoltage to decrease the turns ratio, prohibits the secondary voltage $V_2$ from being increased up to the required secondary voltage $V_r$.

Additionally, the required secondary voltage $V_r$ usually tends to be increased with the passing of time, thereby increasing the possibility of the above problems being encountered. Further, in recent years, a compression ratio of an internal combustion engine is often increased for producing high power and/or an air-fuel ratio is often controlled on a lean side for fuel economy. This will, however, cause the required secondary voltage $V_r$ to be increased, leading to greater concern about the lack of the secondary voltage $V_2$.

SUMMARY OF THE INVENTION

It is therefore a principal object of the present invention to avoid the disadvantages of the prior art.

It is another object of the present invention to provide an improved ignition system for an internal combustion engine which allows a secondary winding to primary winding turns ratio of an ignition coil to be decreased while maintaining a secondary voltage induced in a secondary winding of the ignition coil above a given level of required secondary voltage or alternatively allows the secondary voltage of the ignition coil to be increased without changing the turns ratio of the ignition coil.

According to one aspect of the invention, there is provided an ignition system for an internal combustion engine which comprises an ignition coil including a primary winding and a secondary winding and a switching element for interrupting a current flow through the primary winding of the ignition coil at given timing. The ignition coil has a turns ratio a of the secondary to primary windings which satisfies the condition of $V_D \cdot a > V_r$, where $V_r$ is a required voltage of a spark plug mounted in the engine and $V_D$ is a breakdown voltage of the switching element which is greater than or equal to 450 V.

In the preferred mode of the invention, the turns ratio a falls within a range of 40 to 80.

The ignition coil is disposed within a cylindrical housing, inserted into a plug hole formed in the engine, having a diameter smaller than or equal to 30 mm. The ignition coil is of a magnetically open type.

The ignition coil provides sparking energy to a spark plug installed in a cylinder of the engine without being transferred through a distributor.

A secondary voltage of the ignition coil is greater than or equal to 28 kV.

The switching element is provided with an insulated-gate bipolar transistor. A zener diode is further provided which is connected to the insulated-gate bipolar transistor for preventing overvoltage of the ignition coil. The breakdown voltage $V_D$ of the insulated-gate bipolar transistor is determined based on a breakdown voltage $V_Z$ of the zener diode. The zener diode is built in the insulated-gate bipolar transistor.

The switching element may alternatively be provided with a MOSFET or a bipolar transistor.

According to another aspect of the present invention, there is provided a distributor less ignition system for an internal combustion engine which comprises an ignition coil including a primary winding and a secondary winding and a switching element for interrupting a current flow through the primary winding of the ignition coil at given timing to supply ignition energy to a spark plug of the engine. The ignition coil has a turns ratio a of the secondary to primary windings which satisfies the condition $V_D \cdot a > V_r$, where $V_r$ is a required voltage of the spark plug of the engine and $V_D$ is a breakdown voltage of the switching element which is greater than or equal to 450 V.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings:

FIG. 6 is a graph which shows relations between a primary terminal voltage $V_{10}$ of a primary winding of an ignition coil, as shown in FIG. 7, and a secondary on-voltage $V_{20}$ in terms of turns ratios a;

DESCRIPTION OF THE PREFERRED EMBODIMENT

Figure 1:
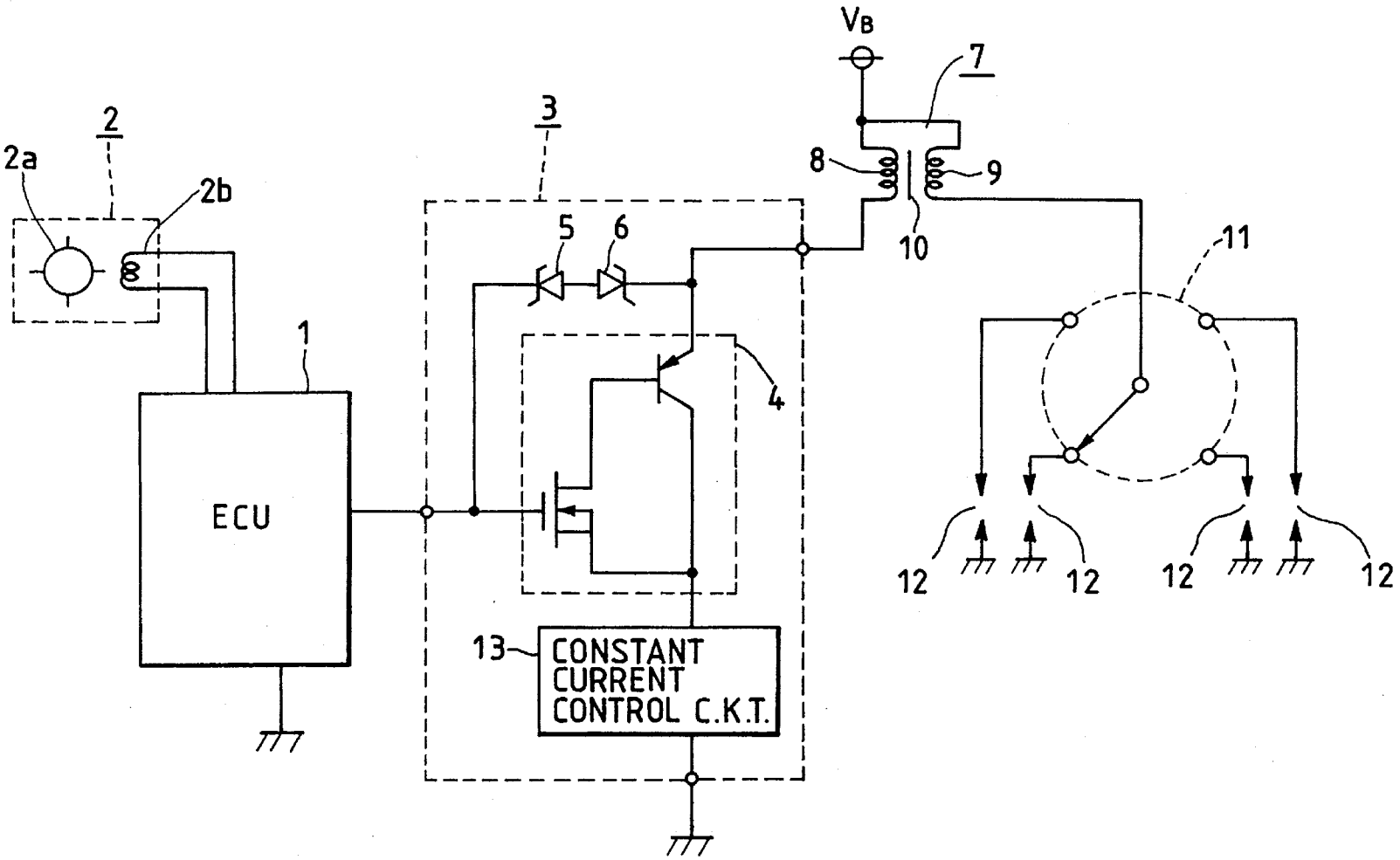
FIG. 1 is a circuit diagram which shows an ignition control system according to the present invention.

Referring now to the drawings, wherein like numbers refer to like parts in several views, particularly to FIG. 1, there is shown an ignition control system for a four-cylinder internal combustion engine. The ignition control system generally includes an electronic control unit (ECU) 1, an igniter 3, an ignition coil 7, and a distributor 11.

The ECU 1 includes a microcomputer, A/D converters, and wave-shaping circuits. Connected to the ECU 1 is an angular sensor 2 which includes a rotor 2*a* rotating according to the engine speed and a pick-up coil 2*b* detecting the passage of teeth formed on the rotor 2*a*.

The igniter 3 is composed of an insulated-gate bipolar transistor (IGBT) 4, a pair of zener diodes 5 and 6 connected in series and oriented in opposite directions, and a constant current control circuit 13. Note that the IGBT 4 is expressed in the form of an equivalent circuit. To a gate terminal of the IGBT 4, the ECU 1 is connected to provide an ignition signal for turning on and off the IGBT 4. The zener diodes 5 and 6 are practically built into the IGBT 4 for reduction in size for an overall circuit structure.

The zener diode 5 is arranged to restrict the voltage appearing between a gate and a collector of the IGBT 4 when a higher voltage is developed at the gate and a lower voltage is developed between the connector and an emitter. The zener diode 6 serves to prevent a primary voltage of the ignition coil 7 from being increased up to the overvoltage. The constant current control circuit 13 connects with the emitter of the IGBT 4 to control the primary current of the ignition coil 7 to a given constant current (6.5 A in this embodiment).

The ignition coil 7 includes a primary winding 8, a secondary winding 9, and an iron core 10. The primary winding 8 connects at one end with the collector of the IGBT 4 and at the other end with a battery source $V_B$. The secondary winding 9 connects with a spark plug 12 of each cylinder through the distributor 11. The ignition coil 7 has a given turns ratio a ($=N_2/N_1$) of the number of turns ($N_2$) of the secondary winding 9 to the number of turns $N_1$ of the primary winding 8 .

With the ignition control system thus constructed, when an electric signal (i.e., an ignition signal) is produced from the ECU 1 to apply the voltage to the gate of the IGBT 4, it will cause IGBT 4 to be turned on to produce a flow of the primary current through the primary winding 8 of the ignition coil 7. The primary current is held at a given current value (e.g., 6.5 A) by the activities of the constant current control circuit 13. By turning on and off the IGBT 4 at given timing, the primary current is interrupted intermittently to create a high level of the secondary voltage at the secondary winding 9 of the ignition coil 7 which, in turn, is applied to one of the spark plugs 12 through the distributor 11. When the secondary voltage of the secondary winding 9 increases over a preselected required secondary voltage, the spark plug 12 strikes an ignition arc.

In this embodiment, the zener voltage $V_Z$ of the zener diode 6 serves to determine a breakdown voltage $V_D$ of the IGBT 4 ($V_D=V_Z$). The zener voltage $V_Z$ is set to 467 V which is higher than that of a typical Darlington transistor. In general, a typical bipolar transistor exhibits antipodal characteristics between an effective withstand voltage and a current amplification factor $h_{FE}$. Because of this, when a given level of the current amplification factor $h_{FE}$ is required, it becomes difficult to increase the effective withstand voltage. However, an increase in the effective withstand voltage is easily achieved by the use of the IGBT 4 in this embodiment with the current amplification factor $h_{FE}$ being zero. The zener voltage $V_Z$ may, thus, be set to high level.

The secondary voltage $V_2$ induced in the secondary winding 9 is determined by the primary energy $W_1$, the secondary capacitance $C_2$, and the conversion efficiency $\eta$ according to the relation of $V_2=\sqrt{(2\cdot W_1/C_2)}\cdot\eta$. Note that the primary energy $W_1$ is determined by the primary winding inductance $L_1$ and the primary winding current $I_1$ according to the relation of $W_1=L_1\cdot I_1^2/2$, and the primary voltage $V_1$ reflected on the primary winding 8 is determined based on the secondary voltage $V_2$ and the turns ratio a according to the relation of $V_1=V_2/a$.

When a high level of the secondary voltage $V_2$ appears at the secondary winding 9, it will cause the primary winding 8 to produce a counterelectromotive force (i.e., the primary voltage $V_1$). As the secondary voltage $V_2$ is increased, the primary voltage $V_1(=V_2/a)$, which is inversely proportional to the turns ratio a of the ignition coil 7, is produced in the primary winding 8.

If the primary voltage $V_1$ is low, then no current flows through the zener diode 6. However, if $V_1$ is increased to $V_2/a>V_Z$, then a current flow is produced through the zener diode 6 so that a current flows through the primary winding 8, thereby decreasing the secondary voltage $V_2$. In this embodiment, the zener voltage $V_Z$ is selected to be higher than the level which satisfies the condition of $V_Z\cdot a>V_r$. Thus, even when the required secondary voltage $V_r$ is induced in the spark plug of the engine, the secondary voltage $V_2$ is maintained at high level without producing a current flow through the primary winding 8. It will be appreciated that a decrease in the turns ratio a is accomplished by setting the zener voltage $V_Z$ to a higher level so as to meet the condition of $V_Z\cdot a>V_r$. In this embodiment, the turns ratio a falls within a range from 40 to 80 (preferably, 70).

In general, in an ignition coil having a cylindrical external configuration inserted into a plug hole extending from an upper portion of an engine body to a mounting hole of a spark plug for mitigating installation restrictions of the spark plug, its measurements are important.

Figure 11:
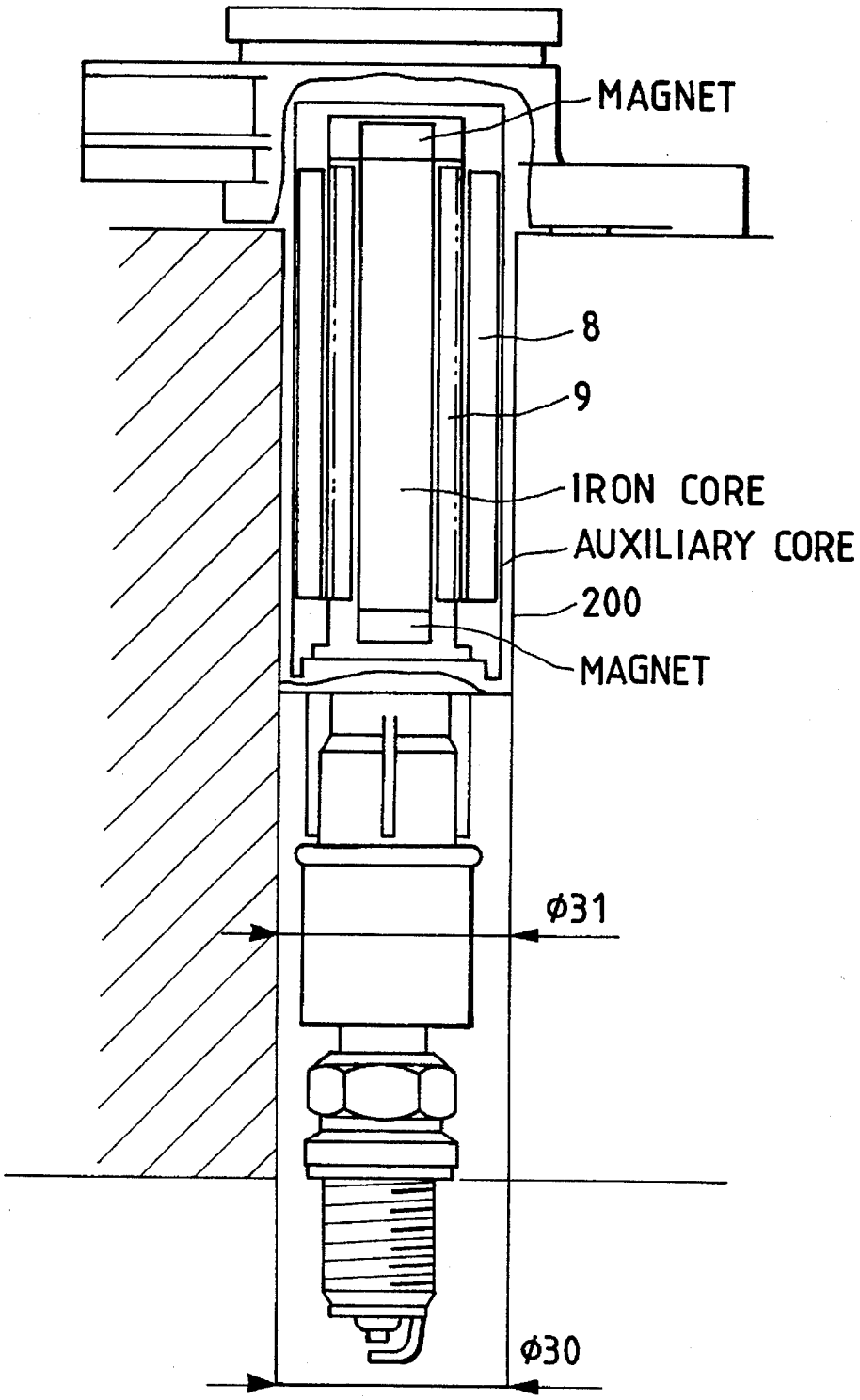
FIG. 11 is a partially cross sectional view which shows an ignition coil inserted into a plug hole formed in an engine.

For example, when a plug hole of the engine, as shown in FIG. 11, is 31 mm in diameter, an outer diameter of a cylindrical body 200 of an ignition coil needs to be less than 30 mm. When the turns ratio a is set to 90 to have the ignition coil produce constant required primary energy and maintain the primary winding current $I_1$ at a given value, an outer diameter of the ignition coil becomes 30.5 mm. If the turns ratio a=80, then the outer diameter is 29.6 mm. Thus, it is desirable that the turns ratio a need to be less than 80 in order to set the outer diameter of the ignition coil less than 30 mm.

In other words, when the required primary energy $W_1=L_1\cdot I_1^2/2$ is maintained constant and the primary current $I_1$ is maintained at a given value, the primary inductance $L_1$ needs to be constant, that is, the number of turns $N_1$ of the primary winding must be set to a given value. Thus, a decreased turns ratio of the ignition coil is achieved by decreasing the number of turns $N_2$ of the secondary winding, thereby resulting in a reduced size of the ignition coil. In this example, the outer diameter of the ignition coil may be decreased.

The shown ignition coil is, as discussed above, reduced in turns ratio, and is also of a magnetically open type for achieving a very small size facilitating easy installation in the plug hole.

The operation of and effect produced by the ignition control system when the required secondary voltage $V_r$ is 30 kV will be described hereinbelow with reference to FIGS. 2 to 4.

Figure 2:
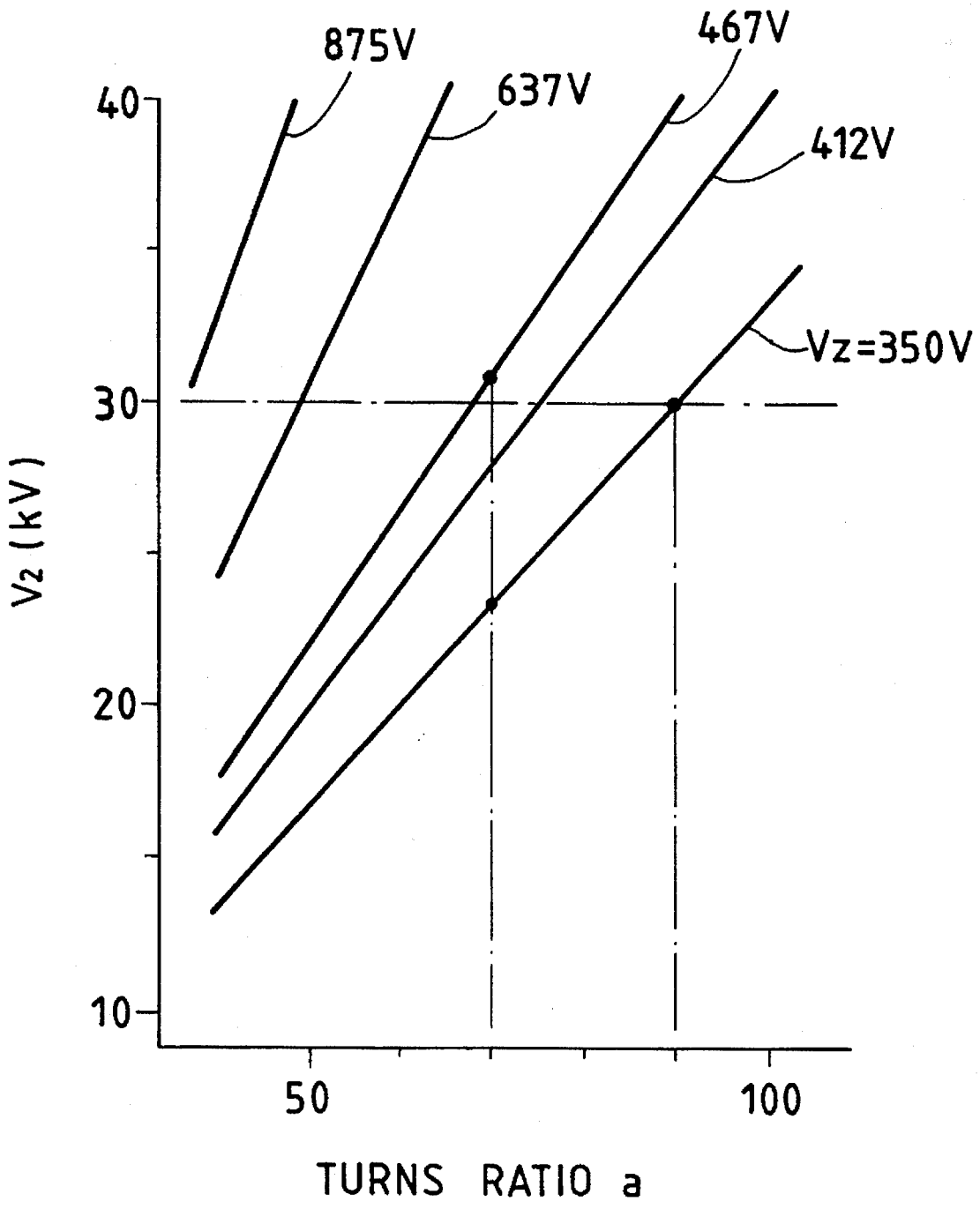
FIG. 2 is a graph which shows relations between a turns ratio a of an ignition coil and a secondary voltage $V_2$ in terms of zener voltages $V_Z$.

FIG. 2 shows the relations between the turns ratio a of the ignition coil 7 and the secondary voltage $V_2$ in terms of the zener voltages $V_Z$ (350, 412, 467, 637, and 875 V). The graph shows that as the zener voltage $V_Z$ and the turns ratio a are increased, the secondary voltage $V_2$ becomes great. The conventional ignition system provided with a Darlington transistor requires a turns ratio a of more than about 90 in order to produce a given level of the required secondary voltage $V_r$(=30 kV) because the zener voltage $V_Z$ is 350 V. In contrast to this, when the IGBT 4 is used and the zener voltage $V_Z$ is set to 467 V, a secondary voltage $V_2$ of about 32 kV will be produced with a turns ratio a of 70 for a good spark or ignition arc across the spark plug electrodes.

When the required secondary voltage $V_r$ is 28 kV which is less than the above value and the zener voltage $V_Z$ is 467 V, the use of the IGBT 4 allows the turns ratio a to be decreased from 70 to 65. In other words, when the required secondary voltage $V_r$ is 28 kV, the secondary voltage $V_2$ which is conventionally 24.5 kV at a zener voltage $V_Z$ of 350 V, may be increased up to 32 kV under conditions that the turns ratio a is 70 and the zener voltage $V_Z$ is 467 V.

Figure 12:
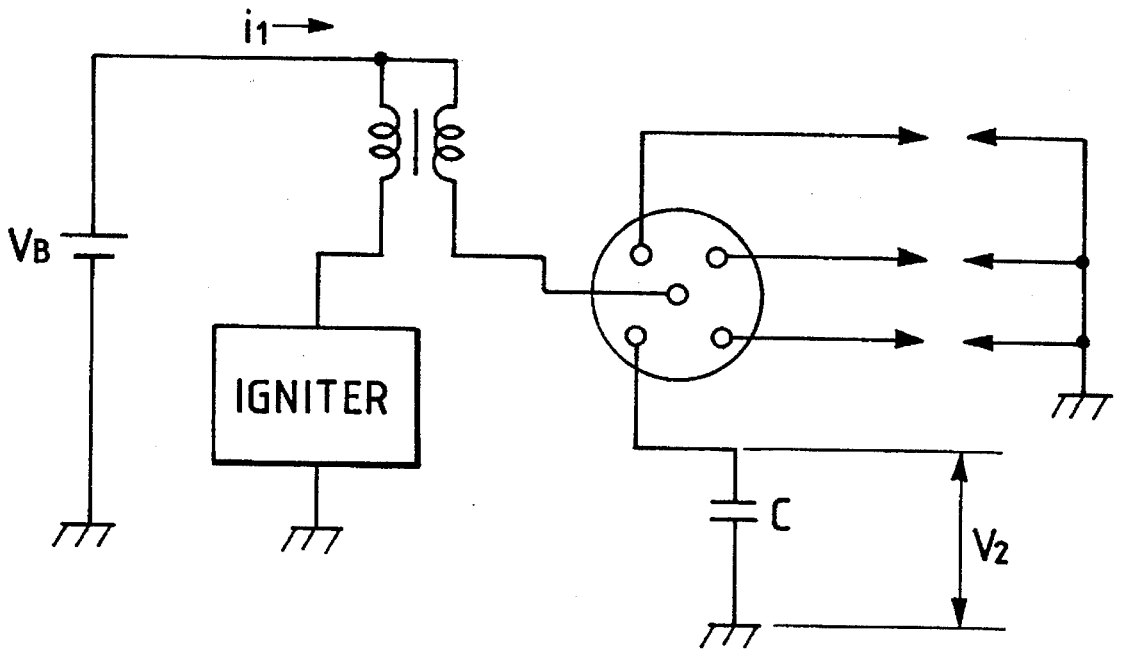
FIG. 12 is a circuit diagram which is designed to measure a secondary voltage level produced in a secondary winding of an ignition coil.

FIG. 12 shows circuit arrangements for measuring the secondary voltage $V_2$ represented in the graph of FIG. 2. This measuring method is generally called an SAE method wherein $V_2$ is measured under conditions of $V_B$=14 V, C=50 pF, and $i_1$=6.5 A.

Figure 3:
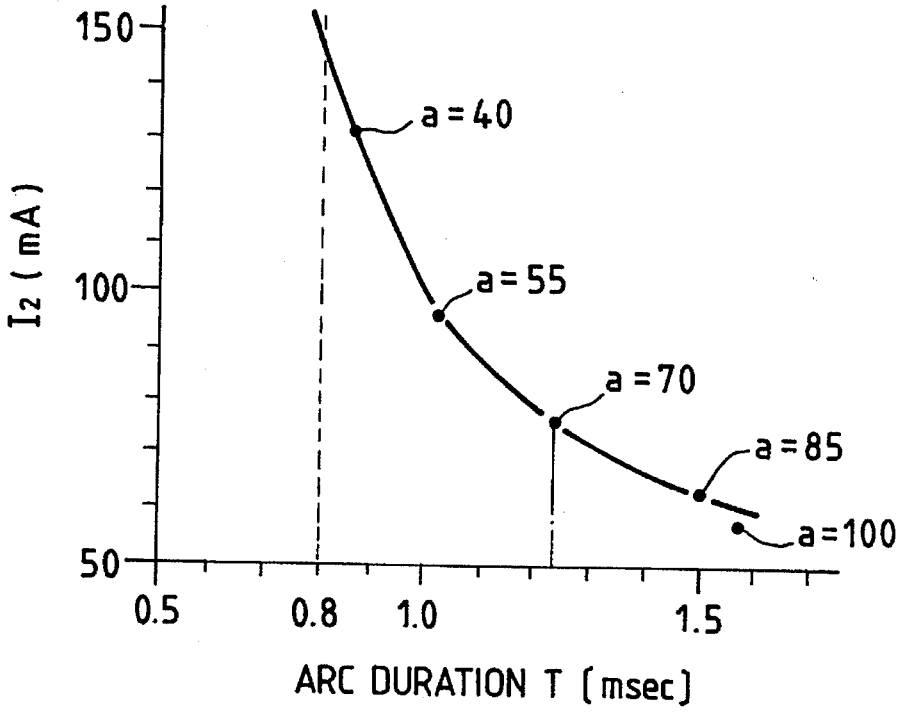
FIG. 3 is a graph which shows relations between an arc current $I_2$ and an arc duration for turns ratios a when a primary current of an ignition coil is interrupted.
Figure 4:
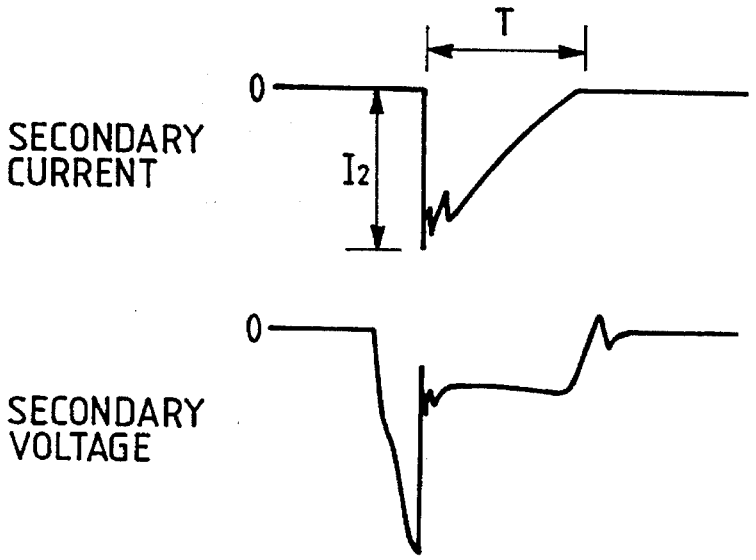
FIG. 4 is a time chart which shows variations in secondary current and secondary voltage.

FIG. 3 shows the relations between an arc current 12 and an arc duration for the turns ratio a when the primary current is interrupted. The arc current 12 and the arc duration T are defined, as shown in FIG. 4, which shows a secondary current waveform and a secondary voltage waveform when the spark plug 12 is discharged. The graph in FIG. 3 shows that the arc duration T is prolonged according to an increase in the turns ratio a. Since the turns ratio a is set to 70 in this embodiment, the arc duration T will be about 1.2 msec.

In FIG. 3, to assure good spark performance requires that the arc duration T to be greater than or equal to 0.8 msec. The arc duration T of this embodiment is, as described above, about 1.2 msec., which satisfies that condition. Additionally, FIG. 3 shows that in order to meet the condition of the arc duration T>0.8 msec., a turns ratio a of at least about 40 is necessary. Thus, when a required secondary voltage $V_r$ of 30 kV is produced with a turns ratio a of 40, an upper limit of the zener voltage $V_Z$ is set to 750 V (=30 kV/40).

Usually, an actual level of the secondary voltage $V_2$ requires a margin for a required secondary voltage $V_r$ of 30 kV. Therefore, assuming that 3 kV is provided practically as the margin, a target level of the secondary voltage $V_2$ at the required secondary voltage $V_r$ of 30 kV will be 33 kV. In this case, according to the graph in FIG. 2, the target level of the secondary voltage $V_2$ is derived with a turns ratio a of 75. Additionally, if a turns ratio a of 40 is indispensable for producing a required secondary voltage of 30 kV in view of the arc characteristics shown in FIG. 3, an upper limit of the zener voltage $V_Z$ is set to 825 V (=33 kV/40).

As apparent from the above discussion, according to this embodiment, the use of the IGBT 4 which turns on and off the primary current of the ignition coil 7 improves the effective withstand voltage, thereby allowing the zener voltage $V_Z$ to be increased. Under the condition of $V_Z\cdot a>V_r$, the turns ratio a may be decreased without reducing in level the secondary voltage $V_2$ of the ignition coil 7. Since the number of turns of the primary winding 8 of the ignition coil 7 is fixed by the primary energy dependent upon the design, in order to decrease the turns ratio a, the number of turns of the secondary winding 9 must be decreased. The decrease in the turns ratio a will result in a reduced size of the spark plug, and also prevent the ignition plug 12 from smoldering. This offers good drivability.

Additionally, even when the required secondary voltage $V_r$ is increased with the passing of time or due to changes in specification (e.g., increase in compression ratio or modification of an air-fuel ratio to a lean side), the turns ratio a of the ignition coil 7 may be reduced while maintaining the secondary voltage $V_2$ above the required secondary voltage $V_r$. Specifically, when the required secondary voltage $V_r$ is 30 kV and an actual target level of the secondary voltage $V_2$ is 33 kV, the zener voltage $V_Z$ may be set to a value in a range from 450 to 825 V. In this case, good sparking performance is obtained as well as miniaturization of the ignition coil 7.

Figure 5:
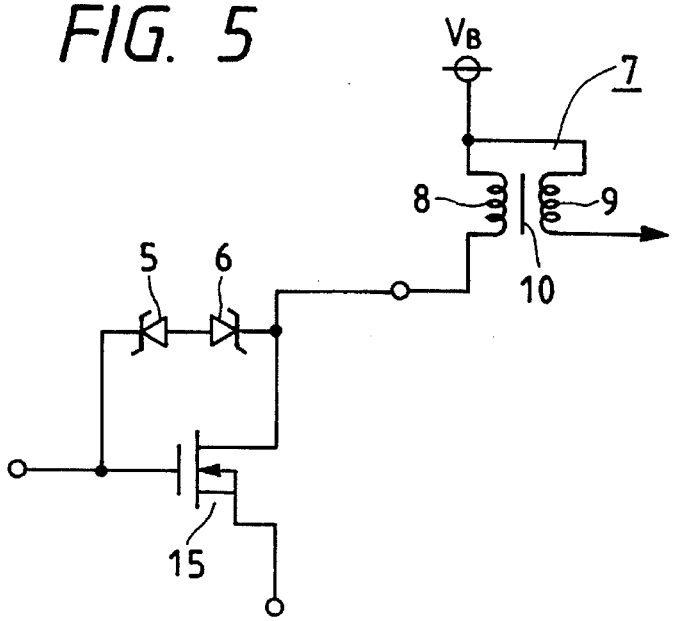
FIG. 5 is a circuit diagram which shows a modification of an ignition control system.

While in the above embodiment, the igniter 3 is provided with the IGBT 4, it may alternatively be provided with a MOSFET. FIG. 5 shows a circuit diagram which uses a MOSFET 15 having disposed therein the zener diode 6. This circuit arrangement also allows the zener voltage $V_Z$ of the zener diode 6 to be set to more than 450 V (preferably, 450 to 825 V) since a withstand voltage of the MOSFET 15 can be easily increased above that of a bipolar transistor.

The ignition control system of this embodiment may be used with a so-called DLI (Distributor Less Ignition) system to supply sparking energy provided by the ignition coil 7 directly to the spark plug 12 of each cylinder without use of the distributor 11. This example also offers the following advantages.

Figure 6:
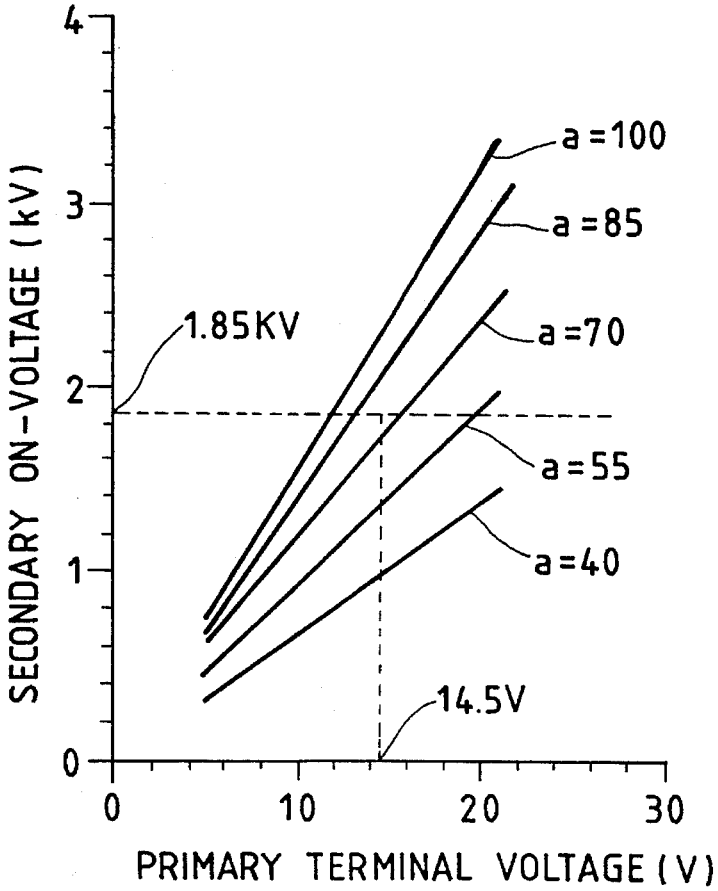
Figure 7:
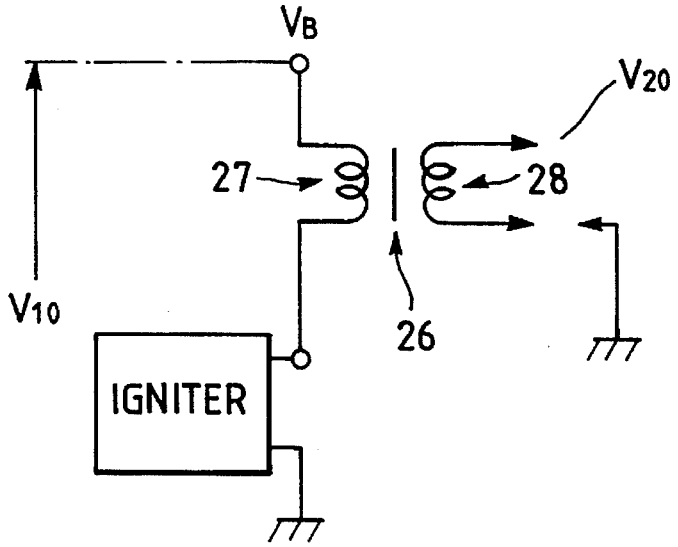
FIG. 7 is a circuit diagram for representing the relations shown in FIG. 6.
Figure 8:
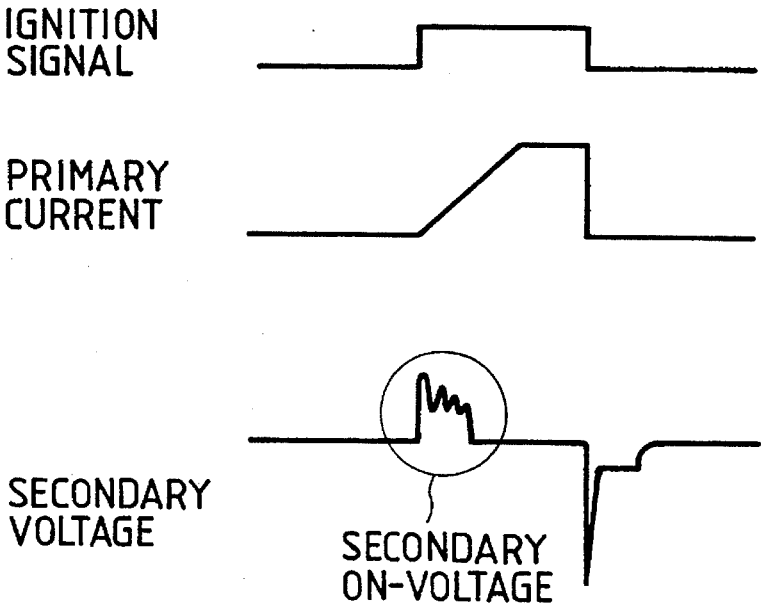
FIG. 8 is an illustration which shows waveforms of an ignition signal, a primary current, and a secondary voltage.
Figure 9:
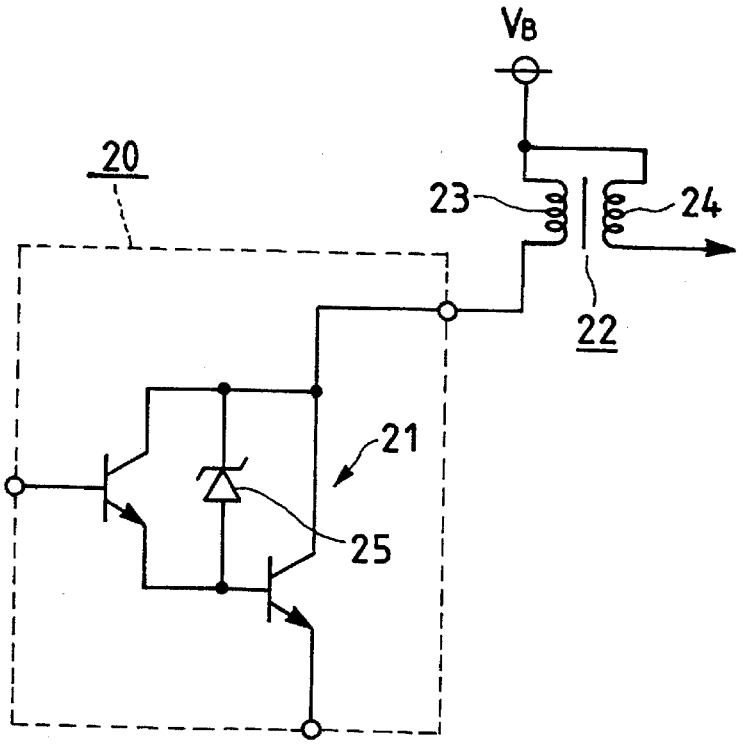
FIG. 9 (PRIOR ART)
FIG. 9 is a circuit diagram which shows a conventional ignition system for an internal combustion engine.

FIG. 6 shows the relation between a primary terminal voltage $V_{10}$ (i.e., battery voltage $V_B$) of a primary winding 27 of an ignition coil 26, as shown in FIG. 7, and a voltage produced in the secondary winding 28 (i.e., a secondary on-voltage $V_{20}$) in terms of the turns ratios a (40, 55, 70, 85, and 100). The secondary on-voltage, as shown in FIG. 8, shows a voltage produced based on a sparking signal from the ECU 1 during energization of the primary winding 8. When this voltage exceeds a given threshold level, it will cause the spark plug 12 to produce an improper ignition arc, leading to overadvanced firing.

It is known in the art that when an spark plug gap is, for example, 0.7 mm, and when the secondary on-voltage exceeds 1.85 kV, it may cause the spark plug to produce an ignition arc, leading to overadvanced firing. Therefore, the overadvanced firing may be avoided by restricting the secondary on-voltage below 1.85 kV. In this embodiment, the turns ratio a is 70, and the secondary on-voltage is maintained below 1.85 kV even at a maximum voltage (the primary terminal voltage =14.5 V) of a typical on-board battery, thereby preventing the overadvanced firing. Additionally, when the spark plug gap is 1.0 mm, the secondary voltage above 2.20 kV may cause the overadvanced firing. However, as long as the turns ratio a is 70, the secondary voltage is always below 2.20 kV, thereby preventing the overadvanced firing.

Figure 10:
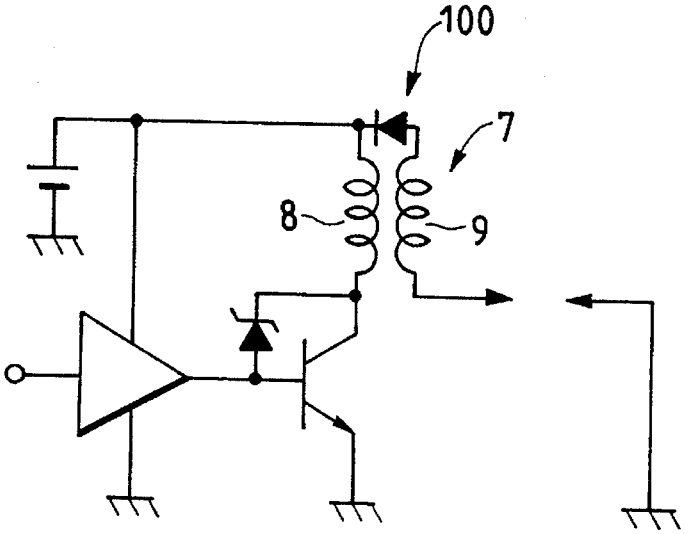
FIG. 10 is a circuit diagram which shows a so-called distributor less ignition system.

An ignition coil employed in the DLI system, as shown in FIG. 10, commonly has a high withstand voltage diode connected in series with a secondary winding for preventing the overadvanced firing due to the secondary on-voltage. The ignition control system of this embodiment, however, eliminates the need for the high withstand voltage diode in the DLI system, resulting in greatly reduced manufacturing costs.

Although the ignition control system of the above embodiment uses the IGBT 4 as a switching element, it may be replaced with another type of switching element such as a MOSFET or a bipolar transistor.

Typical MOSFETs and bipolar transistors are, however, inferior to the IGBT 4 in current capacity per unit area. It is, thus, necessary to use a large-sized element, which is disadvantageous for downsizing requirements.

Additionally, the bipolar transistors have a trade-off relation between effective withstand voltage and current amplification factor. In order to increase a breakdown voltage over 450 V, it is necessary to use an element of sufficient size to assure a desired current capacity. The size of the element needs to be 2.6 times in area than that of the IGBT 4.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A distributor-less ignition system for an internal combustion engine comprising:

an ignition coil including a primary winding and a secondary winding, said ignition coil providing ignition energy directly to a spark plug mounted in a cylinder of the internal combustion engine; and a switching element for interrupting a current flow through the primary winding of said ignition coil at given timing, said switching element being a power-controlling semiconductor switching element and including:

an insulated-gate bipolar transistor; and a controller for controlling the insulated-gate bipolar transistor, the insulated-gate bipolar transistor being coupled between said ignition coil and the controller, said ignition coil having a turns ratio a of the secondary to primary windings which satisfies the following condition:

$$V_D \cdot a > V_r$$

where $V_r$ is a required voltage of the spark plug mounted in the engine which is greater than or equal to 30 kV and $V_D$ is a breakdown voltage of said switching element which is greater than or equal to 450 V and less than or equal to 750 V, such that when the breakdown voltage $V_D$ is 450 V, the turns ratio a is greater than a value given by an equation of $V_r/V_D$=30 kV/450 V and less than or equal to 80, and when the breakdown voltage $V_D$ is 750 V, the turns ratio a is greater than or equal to 40 and less than or equal to 80.

a pair of zener diodes being coupled between said ignition coil and the controller and bypassing the insulated-gate bipolar transistor, said pair of zener diodes being oriented in opposite directions to define the breakdown voltage $V_D$.

* * * * *